US007337812B2

(12) United States Patent
Williams

(10) Patent No.: US 7,337,812 B2
(45) Date of Patent: Mar. 4, 2008

(54) MULTI-FUNCTION ADJUSTABLE ROUTER BASE

(76) Inventor: Gary E. Williams, 1505 Cherokee Strip, Blue Springs, MO (US) 64015

( * ) Notice: Subject to any disclaimer, the term of this patent is extended or adjusted under 35 U.S.C. 154(b) by 8 days.

(21) Appl. No.: 11/201,548

(22) Filed: Aug. 11, 2005

(65) Prior Publication Data

US 2006/0032553 A1 Feb. 16, 2006

Related U.S. Application Data

(60) Provisional application No. 60/601,560, filed on Aug. 13, 2004.

(51) Int. Cl.
*B27C 5/10* (2006.01)

(52) U.S. Cl. ..... 144/136.95; 144/144.52; 144/145.2; 144/154.5

(58) Field of Classification Search ..... 144/134.1, 144/135.2, 136.95, 144.51, 144.52, 145.2, 144/154.5, 371, 372, 253.2, 253.6; 409/180–182, 409/175, 130; 33/562, 197; 83/574, 754
See application file for complete search history.

(56) References Cited

U.S. PATENT DOCUMENTS

| | | | | |
|---|---|---|---|---|
| 1,904,109 | A | 4/1933 | Wendorf | |
| 2,705,032 | A | 3/1955 | Pearson | |
| 2,752,961 | A | 7/1956 | Melgaard | |
| 2,943,655 | A | 7/1960 | Pedersen et al. | |
| 3,450,001 | A * | 6/1969 | Fortune | 409/178 |
| 3,478,788 | A | 11/1969 | Zelik | |
| 3,841,368 | A * | 10/1974 | Ritter | 144/136.1 |
| 4,044,805 | A | 8/1977 | Gronholz | |
| 4,065,114 | A * | 12/1977 | Pennington | 269/2 |
| 4,155,383 | A * | 5/1979 | Welliver | 144/154.5 |
| 4,281,694 | A * | 8/1981 | Gorman | 144/154.5 |
| 4,290,719 | A | 9/1981 | Worthington et al. | |
| 4,615,654 | A | 10/1986 | Shaw | |
| 4,630,656 | A * | 12/1986 | Collins | 144/154.5 |
| 4,630,657 | A * | 12/1986 | Obradovich | 144/144.52 |
| 4,685,496 | A | 8/1987 | Livick | |
| 4,718,468 | A | 1/1988 | Cowman | |
| RE33,045 | E | 9/1989 | Gronholz et al. | |
| 4,921,023 | A | 5/1990 | Pempek | |
| 4,966,507 | A | 10/1990 | Hanks | |
| 4,977,938 | A * | 12/1990 | Greeson | 144/154.5 |
| 5,052,454 | A * | 10/1991 | Meinhardt | 144/144.51 |
| 5,090,461 | A | 2/1992 | Gakhar et al. | |
| 5,123,463 | A | 6/1992 | Grisley | |
| 5,240,052 | A | 8/1993 | Davison | |
| 5,285,831 | A * | 2/1994 | Woolgar | 144/48.6 |

(Continued)

OTHER PUBLICATIONS

Ralph Bagnall, *The Ultimate Fluting Jig*, Woodworker's Journal, Feb. 2004, at 75-80.

*Primary Examiner*—Bena Miller
(74) *Attorney, Agent, or Firm*—Hovey Williams LLP

(57) ABSTRACT

An adjustable router base suitable for attachment to conventional manual routers. In one configuration, the router base permits easy and accurate adjustment of the router bit relative to a variety of fixed guiding edges (e.g., the edge of a workpiece or a straight edge) or points (e.g., the pivot point of an arcuate cut). In another configuration, the router base permits the router to be used in a conventional manner to cut an edge on a workpiece.

29 Claims, 7 Drawing Sheets

U.S. PATENT DOCUMENTS 5,289,861 A 3/1994 Hedrick
5,325,899 A 7/1994 Kochling
5,492,160 A 2/1996 McCracken
5,694,994 A * 12/1997 Engler et al. ..... 144/286.1
5,758,998 A 6/1998 White
5,778,949 A 7/1998 Draves
5,813,807 A * 9/1998 Rogers ..... 409/178
5,960,843 A * 10/1999 Witt ..... 144/372
6,065,913 A 5/2000 Rogers
6,070,626 A 6/2000 Tully
6,158,930 A 12/2000 Etter
6,334,744 B1 1/2002 Jasper et al.
6,363,982 B1 4/2002 Nixon, Jr.
6,585,018 B2 7/2003 Butaud
6,799,615 B2 10/2004 Smith

* cited by examiner

MULTI-FUNCTION ADJUSTABLE ROUTER BASE

RELATED APPLICATIONS

This application claims the priority of Provisional Patent Application Ser. No. 60/601,560, filed Aug. 13, 2004, entitled MULTI-FUNCTION ADJUSTABLE ROUTER BASE, which is hereby incorporated by reference herein.

BACKGROUND

1. Field of the Invention

The present invention relates generally to guide attachments for manual routers used in woodworking. More particularly, the present invention concerns an improved router base for use with a router during various cutting operations.

2. Description of the Prior Art

A router can be a very versatile woodworking tool, in that it can perform many functions. A router having the appropriate bits and attachments can contour pieces of wood, machine out grooves and other decorative features in the surface of wood, and so on. Many router attachments are available from either a router manufacturer or other tool makers which can be mounted to the router to perform these various functions. For example, a base can be provided that has an edge guide in order to guide a router along a path perpendicular to the edge of a workpiece while maintaining a consistent distance from the edge of the workpiece to the groove created by the router. Another attachment can be provided that enables the router to move in a radial path in order to create consistent curvilinear grooves in a workpiece. Additionally, another attachment can be obtained to guide a router along the path of a straight edge in order to create a straight groove in a workpiece when the desired distance from the edge of the work piece to the groove is too great to span using the above mentioned edge guide.

Although each of these tools may be provided by different manufacturers or tool makers, each requires the purchase of the separate attachments individually. Thus, it is desirable to have a single attachment which can perform all of these functions in order to minimize the cost spent on router accessories and the complexity of mounting, removing, and remounting different accessories to the router.

OBJECTS AND SUMMARY OF THE INVENTION

Accordingly, it is an object of the present invention to provide a router accessory that has an edge guide in order to guide a router along a path perpendicular to the edge of a workpiece while maintaining a consistent distance from the edge of the workpiece to the groove created by the router.

A further object of the present invention is to provide a router accessory that guides a router along the path of a straight edge in order to create a straight groove in a workpiece.

A still further object of the present invention is to provide a router accessory that enables a router to move in a radial path in order to create consistent curvilinear grooves in a workpiece.

In one embodiment of the present invention there is provided an adjustable router base comprising a normally-lower member, a normally upper member, and an edge guide. The normally-lower member presents a substantially planar lower surface. The normally-upper member is coupled to the normally-lower member and shiftable relative to the normally-lower member. The edge guide is coupled to the normally-lower member and shiftable between a down position and an up position. At least a portion of the edge guide extends below the substantially planar lower surface when in the down position. The edge guide is positioned entirely above the substantially planar lower surface when in the up position.

In another embodiment of the present invention there is provided an adjustable router base suitable for use in conjunction with a router and a straight edge, where the straight edge has an elongated slot formed therein. The adjustable router base comprises a normally-lower member, a normally upper member, and a protrusion. The normally-lower member presents a substantially planar lower surface. The normally-upper member is configured for rigid attachment to the router. The normally-upper member is shiftably coupled to the normally-lower member. The protrusion is fixed relative to the normally-lower member and extends in a generally downward direction. The protrusion is configured for receipt in the elongated slot of the straight edge so as to permit travel of the protrusion through the elongated slot in the direction of elongation of the slot, while inhibiting shifting of the protrusion in the slot in a direction perpendicular to the direction of elongation of the slot.

In a further embodiment of the present invention there is provided a method of operating a router coupled to an adjustable router base. The adjustable router base includes a normally-lower member, a normally-upper member, and an edge guide coupled to the normally-lower member. The router is rigidly coupled to the normally-upper member. The operating method includes the following steps: (a) placing at least a portion of the guide member in contact with a guiding edge; (b) using the router to make an elongated first cut in a workpiece while maintaining contact between the guide member and the guiding edge; (c) shifting the normally-upper member relative to the normally-lower member; (d) using the router to make an elongated second cut in the workpiece while maintaining contact between the guide member and the guiding edge, where the first and second cuts are located different distances from the guiding edge; (e) decoupling the normally-upper member from the normally-lower member; and (f) while the normally-upper member is decoupled from the normally-lower member, using the router to make a third cut in the same workpiece or a different workpiece.

BRIEF DESCRIPTION OF THE DRAWINGS

Embodiments of the present invention are described herein with reference to the following drawing figures wherein.

DETAILED DESCRIPTION OF THE PREFERRED EMBODIMENTS

Figure 1:
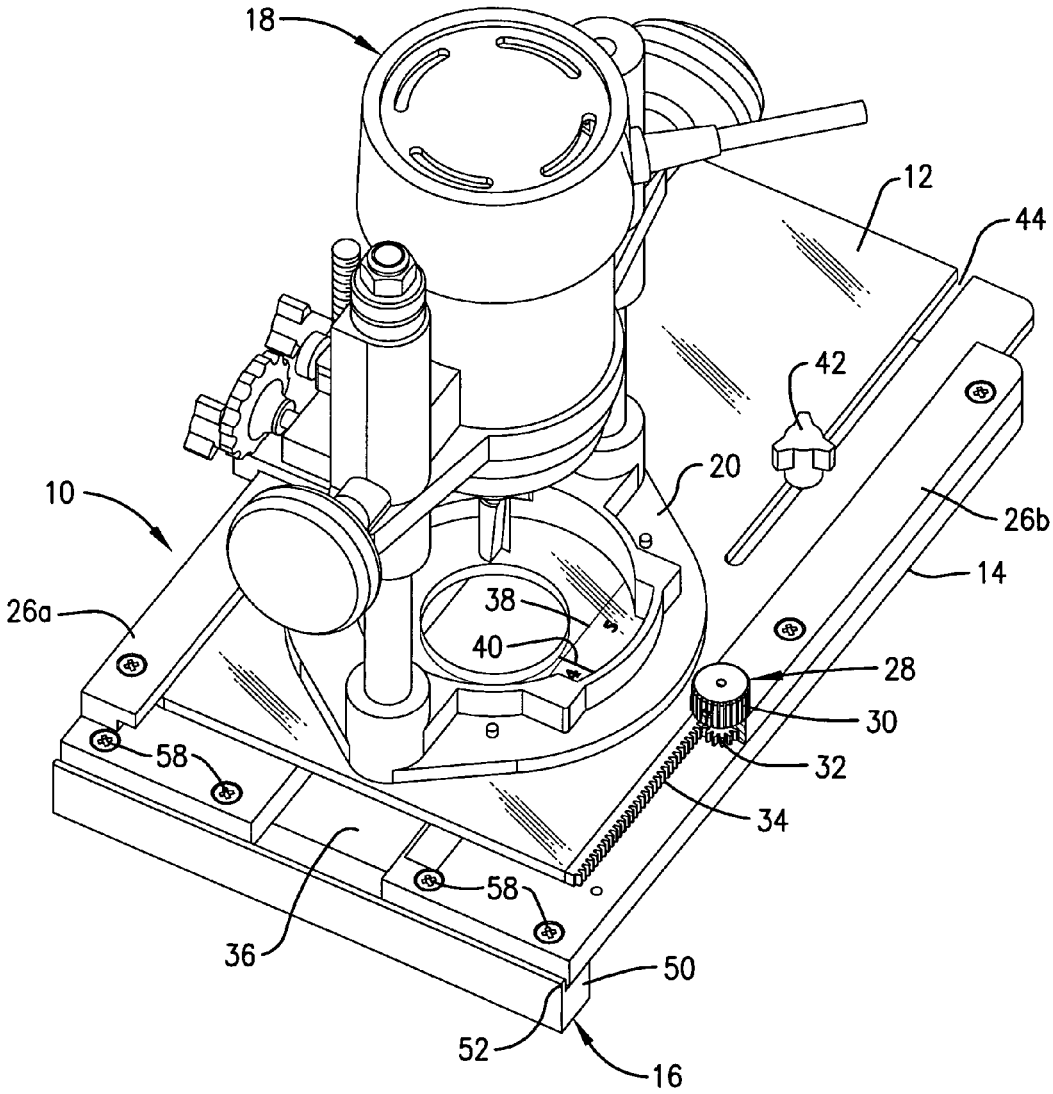
FIG. 1 is an isometric view of a router coupled to an adjustable router base.
Figure 2:
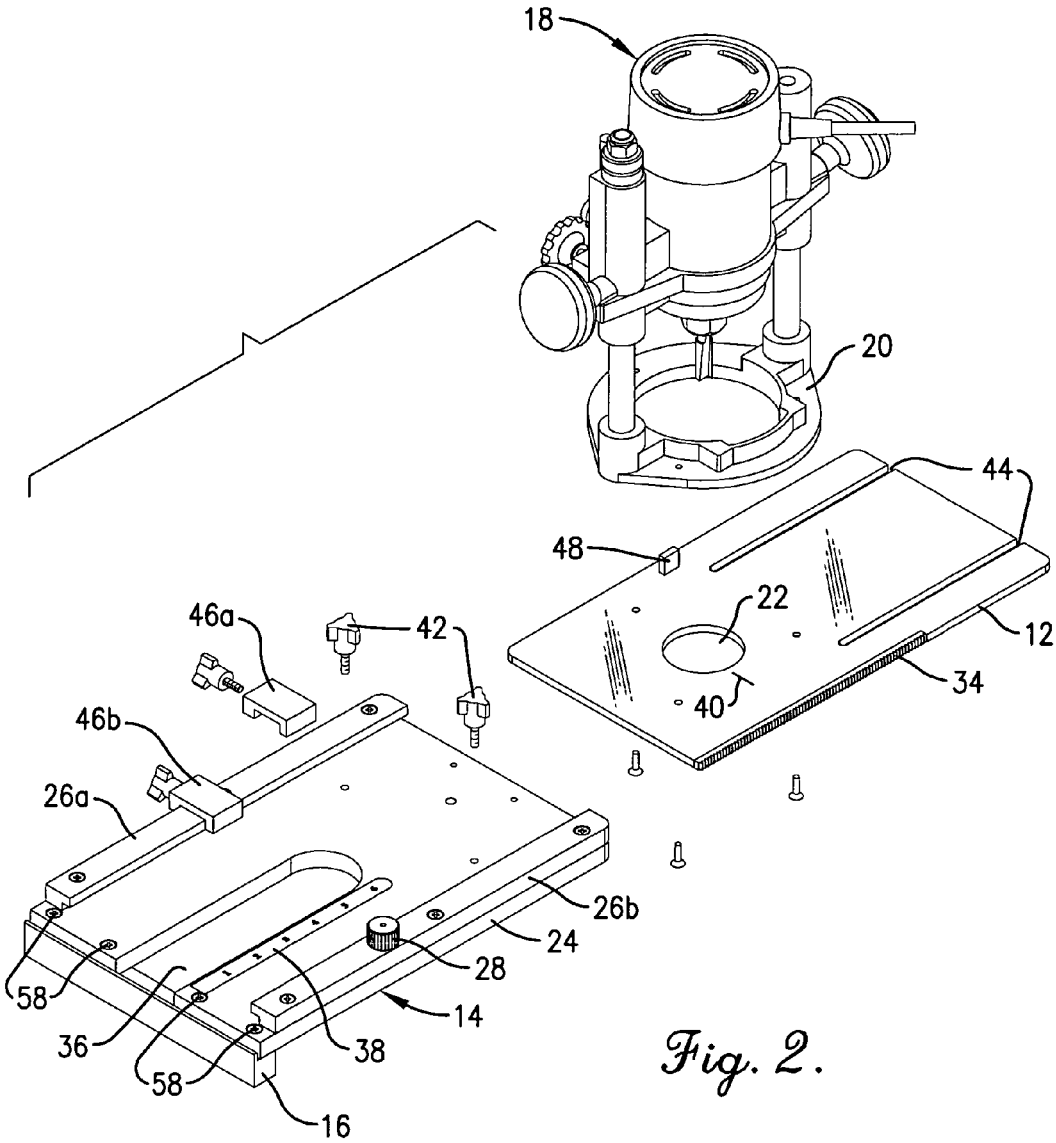
FIG. 2 is an assembly view of the router and adjustable router base.

Referring initially to FIGS. 1 and 2, an adjustable router base 10 constructed in accordance with one embodiment of the present invention is illustrated as generally comprising an upper member 12, a lower member 14, and an edge guide 16. Upper member 12 is configured to be securely coupled to a conventional router 18. As perhaps best illustrated in FIG. 2, upper member 12 can be constructed with pre-drilled holes which can be aligned with the threaded openings provided in the standard base 20 of router 18. A plurality of screws can be extended through the openings in upper member 12 and threaded into the openings in standard base 20 to thereby securely fix router 18 to upper member 12. In certain instances, conventional router 18 is originally equipped with a sub-base (not shown) coupled to the bottom of standard base 20 that must be removed prior to attachment of upper member 12 to standard base 20. Upper member 12 defines an upper opening 22 which is aligned with the axis of rotation of the bit of router 18 and permits the bit of router 18 to extend therethrough.

In accordance with one embodiment of the present invention, when router 18 is coupled to upper member 12, router 18 and upper member 12 can be used independently of lower member 14 and edge guide 16. When router 18 and upper member 12 are used without lower member 14 and edge guide 16, upper member 12 simply acts as a replacement for the standard sub-base provided by the manufacturer of router 18. When it is desired to cut an edge of a workpiece with router 18, it is preferred for router 18 and upper member 12 to be used independently of lower member 14 and edge guide 16. However, as discussed in further detail below, when it is desired to use router 18 to cut a groove (e.g., a dado) at a location spaced from the edge of the workpiece, it is preferred for router 18 and upper member 12 to be coupled to and used in conjunction with lower member 14 and edge guide 16.

When router 18 and upper member 12 are used in conjunction with lower member 14 and edge guide 16, upper member 12 is coupled to lower member 14 in a manner that permits shifting of upper member 12 relative to lower member 14 along a substantially linear path, while relative shifting of upper and lower members 12,14 in any direction other than along the substantially linear path is inhibited. Lower member 14 preferably comprises a substantially flat base plate 24, a pair of laterally-spaced first and second side guides 26*a,b,* and a fine-tuning system 28. Each side guide 26 is preferably formed of an elongated member having a generally L-shaped cross section. Side guides 26*a,b* are coupled to base plate 24 proximate opposite edges of base plate 24. Side guides 26*a,b* are coupled to base plate 24 so that each side guide 26 is positioned in a generally upside-down "L" configuration with the projecting legs of the upside-down "L" extending towards one another. In such a configuration, an open channel is defined between each side guide 26 and the upper surface of base plate 24. The channels defined by side guides 26*a,b* are open towards one another and are configured to receive upper member 12 therebetween. Thus, side guides 26*a,b* coupled upper member 12 to lower member 14 in a manner that permits translation of upper member 12 relative to lower member 14 along a substantially linear path, with the edges of upper member 12 traveling through the channels during relative shifting of upper and lower members 12,14. Further, side guides 26*a,b* are operable to hold upper member 12 down onto lower member 14 so that a substantially flat upper surface of base plate 24 and a substantially flat lower surface of upper member 12 are maintained in continuous engagement with one another.

Referring again to FIGS. 1 and 2, fine-tuning system 28 can assume a variety of different configurations. As used herein, "fine-tuning system" denotes a mechanism that causes relative movement between upper member 12 and lower member 14 when actuated, and also restrains free movement of the members 12,14 relative to one another during actuation.

As perhaps best illustrated in FIG. 1, in one embodiment of the present invention, fine-tuning system 28 includes an actuating knob 30, a pinion gear 32, and a rack gear 34. Rack gear 34 is formed in or coupled to an edge of upper member 12. Pinion gear 32 and actuating knob 30 are rotatably coupled to side guide 26*b*. When the edge of upper member 12 is properly received in the channel defined between side guide 26*b* and base plate 24, rack gear 34 and pinion gear 32 form a mating relationship. Actuating knob 30 and pinion gear 32 are coupled to one another so that rotation of actuating knob 30 causes rotation of pinion gear 32. When actuating knob 30 and pinion gear 32 are rotated, the interaction between pinion gear 32 and rack gear 34 causes upper member 12 to shift relative to lower member 14. It is preferred for a certain degree of frictional resistance to exist in fine-tuning system 28 and/or between upper and lower members 12,14 in order to somewhat restrain free rotation of actuating knob 30. This frictional resistance helps secure the position of upper member 12 relative to lower member 14 after a fine-tuned adjustment has been made with fine-tuning system 28, but before upper member 12 and lower member 14 have been securely locked relative to one another, as will be discussed in further detail below.

Referring again to FIGS. 1 and 2, base plate 24 of lower member 14 defines a lower opening 36. When upper member 12 and lower member 14 are coupled to one another, upper opening 22 of upper member 12 and lower opening 36 of lower member 14 are aligned with one another so that the bit of router 18 can extend through both openings 22,36. Preferably, lower opening 36 is elongated in the direction of travel of upper member 12 relative to lower member 14 so that upper opening 22 maintains alignment with lower opening 36 when the position of upper member 12 is adjusted relative to lower member 14.

As shown in FIG. 2, a scale 38 can be coupled to, embossed, or engraved in lower member 14. If scale 38 is formed of a separate member than base plate 24, it is preferred for scale 38 to be received in a recess formed in the top of base plate 24 so that the upper surface of scale 38 is co-planar with the upper surface of base plate 24. As shown in FIG. 2, a tick mark 40 can be provided on/in upper member 12. Tick mark 40 is aligned over or adjacent scale 38 when upper member 12 is coupled to lower member 14 with upper opening 22 aligned over lower opening 36. It is preferred for upper member 12 to be formed of a clear polycarbonate material (e.g., Plexiglass™) so that scale 38 is visible through upper member 12. Alternatively, upper member 12 can be constructed with an opening/window through which scale 38 can be viewed. In such a configuration, tick mark 40 would be located in the opening/window. In an alternative embodiment, scale 38 could be located on upper member 12, while tick mark 40 is located on lower member 14.

As discussed above, the position of upper member 12 relative to lower member 14 can be adjusted using fine-tuning system 28. Once router base 10 has been adjusted to the desired cutting position, upper member 12 is secured to lower member 14 to prevent shifting when router 18 is used to perform a cut. FIGS. 1 and 2 illustrate a friction locking mechanism 42 which is operable to increase and decrease the frictional engagement force between the bottom surface of upper member 12 and the upper surface of lower member 14. In the embodiment illustrated in FIGS. 1 and 2, friction locking mechanism 42 includes two rotatable locking knobs, each including a broad unthreaded head portion and a narrow threaded lower portion. The head portions of the locking knobs are disposed above the top surface of upper member 12, while the threaded lower portions of the locking knobs extend through spaced-apart slots 44 in upper member 12 and are received in threaded openings formed in lower member 14. When it is desired to lock upper member 12 and lower member 14 to one another, the locking knobs can be rotated in a direction that causes the threaded lower portion to move further into the threaded openings of lower member 14. This downward movement of the locking knobs forces the bottom of the head portion into the top of upper member 12 adjacent slots 44. As locking knobs are tightened, the frictional force between the bottom surface of upper member 12 and the top surface of lower member 14 is increased, thereby locking the two members 12,14 to one another. Prior to shifting upper member 12 relative to lower member 14, locking knobs must be rotated in the opposite direction to reduce the frictional force between upper and lower members 12,14.

Figure 3:
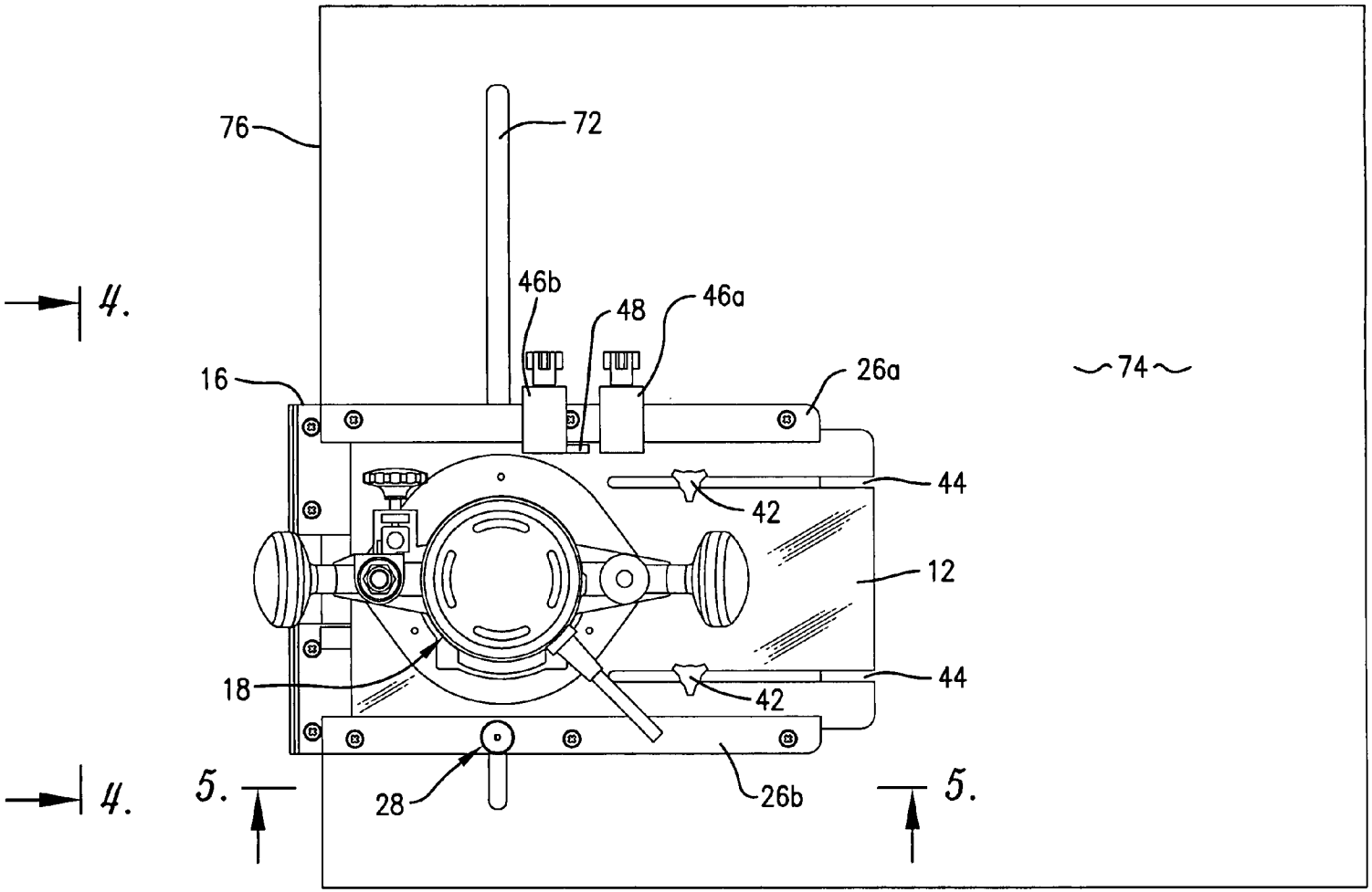
FIG. 3 is a top view of the router and adjustable router base being used to cut a dado in a workpiece, particularly illustrating the router base being guided by an edge of the workpiece.

Referring now to FIGS. 2 and 3, adjustable router base 10 can also be equipped with first and second stop mechanisms 46*a,b* which cooperate with a projecting lug 48 to thereby limit travel of upper member 12 relative to lower member 14. In the embodiment illustrated in FIGS. 2 and 3, first and second stop mechanisms 46*a,b* are shiftably coupled to first side guide 26*a*, while lug 48 is fixed to and projects upwardly from the top surface of upper member 12. When upper member 12 is received in lower member 14, lug 48 is disposed between stop mechanisms 46*a,b*. Stop mechanisms 46*a,b* limit the travel of upper member 12 relative to lower member 14 by engaging lug 48. Stop mechanisms 46*a,b* include a generally C-shaped hanging body and a threaded locking knob. The positions of stop mechanisms 46*a,b* can be independently adjusted relative to first side guide 26*a* by loosening the threaded locking knobs, sliding stop mechanisms 46*a,b* on first guide member 26*a*, and then retightening the threaded locking knobs.

Referring now to FIGS. 1, 2, 5, and 7, edge guide 16 is shiftably coupled to lower member 14. Edge guide 16 is shiftable between a down position (illustrated in FIGS. 1-5) and an up position (illustrated in FIGS. 6-9). When edge guide 16 is in the down position, at least a portion of edge guide 16 extends below the substantially planar lower surface of lower member 14. However, when edge guide 16 is in the up position, all of edge guide 16 is positioned above the lower surface of lower member 14.

Figure 5:
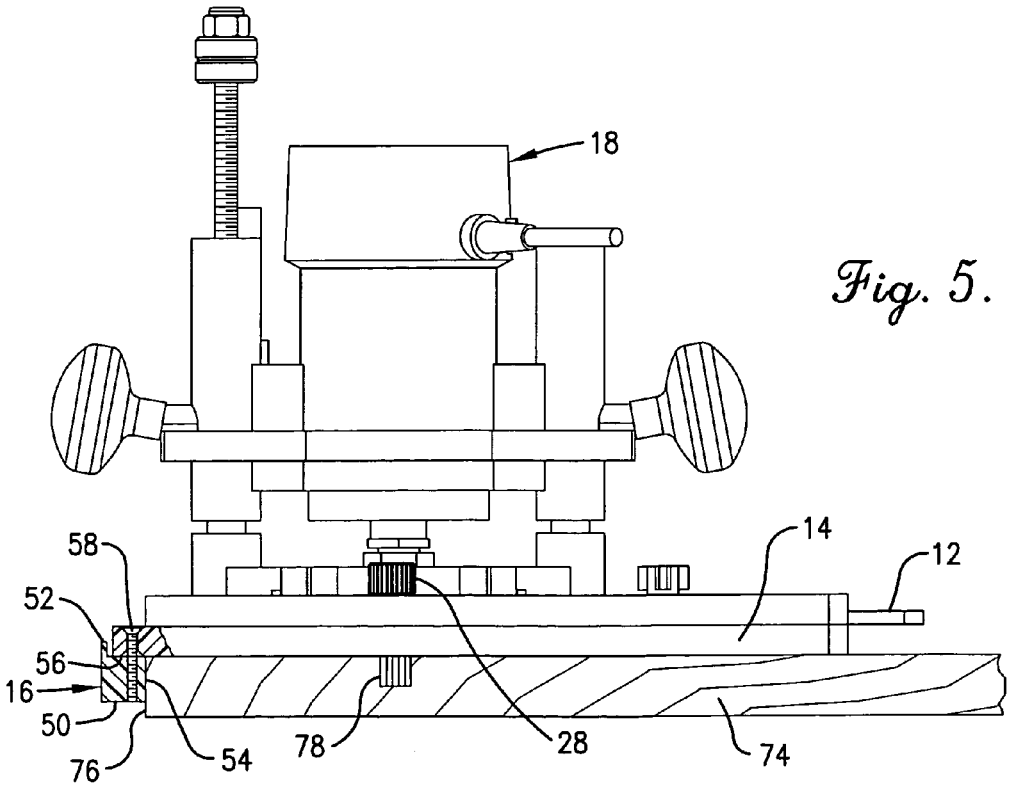
FIG. 5 is a partially cut-away side view of the router, adjustable router base, and workpiece indicated by lines 5-5 in FIG. 3, where the cut-away portion illustrates the manner in which the edge guide of the router base is coupled to a lower member of the router base in a down position with a protrusion of the edge guide projecting upward.
Figure 7:
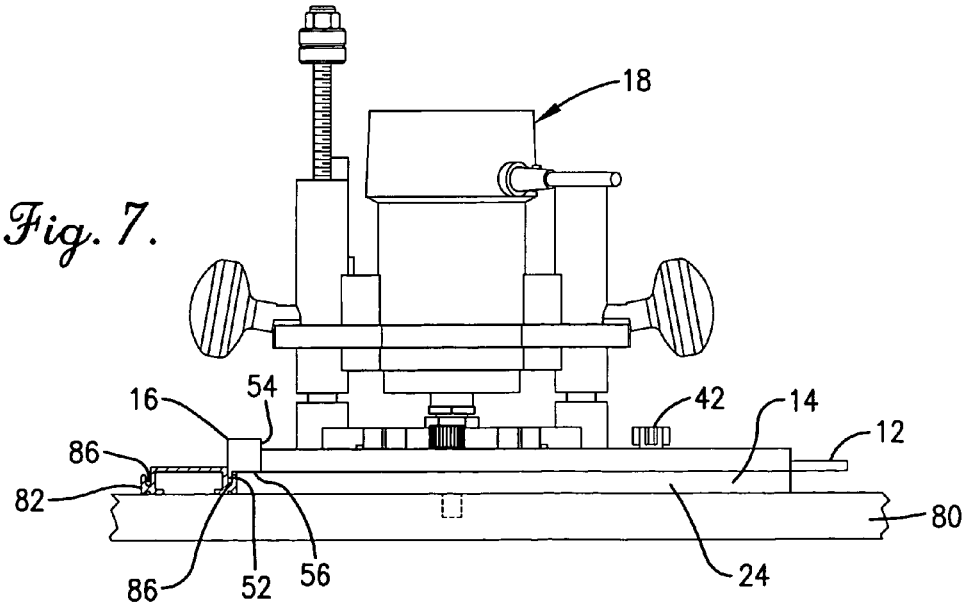
FIG. 7 is a side view of the router, adjustable router base, straight edge, and workpiece indicated by lines 7-7 in FIG. 6, particularly illustrating the manner in which the edge guide is coupled to the lower member of the adjustable router base in an up position where the protrusion of the edge guide projects downward into the slot of the straight edge.

As perhaps best illustrated in FIGS. 5 and 7, edge guide 16 includes a main body 50 and a protrusion 52 extending from main body 50. Main body 50 presents a guide face 54 and a securement face 56. When edge guide 16 is in the down position (FIG. 5), guide face 54 presents a substantially planar surface that extends below and substantially perpendicular to the substantially planar lower surface of lower member 14. Further, when edge guide 16 is in the down position (FIG. 5), securement face 56 engages the lower surface of lower member 14. Finally, when edge guide 16 is in the down position (FIG. 5), protrusion 52 extends generally upward. When edge guide 16 is in the up position (FIG. 7), guide face 54 is located entirely above the lower surface of lower member 14. Further, when edge guide 16 is in the up position (FIG. 7), securement face 56 engages the upper surface of base plate 24 of lower member 14. Finally, when edge guide 16 is in the up position (FIG. 7), protrusion 52 extends generally downward.

A variety of different mechanisms can be employed to permit shifting of edge guide 16 relative to lower member 14 between the up and down positions. For example, edge guide 16 can be coupled to lower member 14 by a locking hinge or locking pivot which permits shifting of edge guide 16 between the up and down positions without completely decoupling edge guide 16 from lower member 14. However, in the embodiment illustrated in FIGS. 1-9, edge guide 16 is coupled to lower member 15 by a plurality of removable screws 58 (FIGS. 2, 5, and 8) which extend through unthreaded openings in edge guide 16 and into threaded openings in base plate 24 of lower member 14. The threaded openings in base plate 24 preferably extend entirely through base plate 24 so that the threaded openings can be accessed from the bottom and top of base plate 24.

In order to shift edge guide 16 from the down position (FIGS. 1-5) to the up position (FIGS. 6-9), the following steps are performed in sequence: (1) edge guide 16 is decoupled from lower member 14 by unscrewing removable screws 58 (FIGS. 2 and 5) from lower member 14; (2) edge guide 16 is then repositioned so that securement face 56 (FIG. 7) engages the top surface of base plate 24 with protrusion 52 pointing downward and the unthreaded openings in edge guide 16 aligned with the threaded openings in base plate 24; and (3) recoupling edge guide 16 to lower member 14 by extending removable screws 58 (FIG. 8) through the unthreaded openings in edge guide 16 and into the threaded openings in base plate 24 of lower member 14.

In order to shift edge guide 16 from the up position (FIGS. 6-9) to the down position (FIGS. 1-5), the following steps are performed in sequence: (1) edge guide 16 is decoupled from lower member 14 by unscrewing removable screws 58 (FIG. 8) from lower member 14; (2) edge guide 16 is then repositioned so that securement face 56 (FIG. 5) engages the bottom surface of base plate 24 with protrusion 52 pointing upward and the unthreaded openings in edge guide 16 aligned with the threaded openings in base plate 24; and (3)

recoupling edge guide 16 to lower member 14 by extending removable screws 58 (FIGS. 2 and 5) through the unthreaded openings in edge guide 16 and into the threaded openings in base plate 24 of lower member 14.

Figure 8:
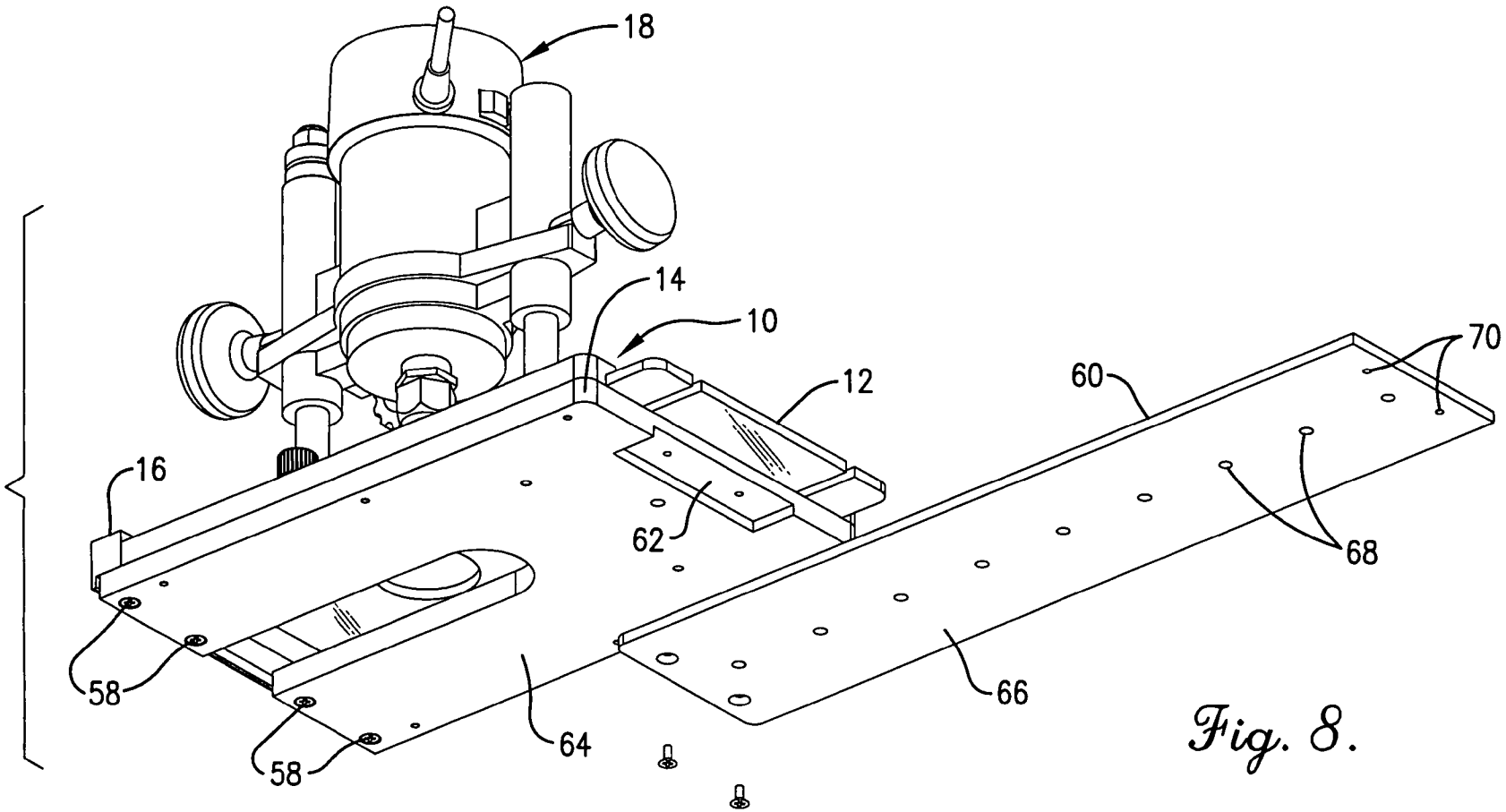
FIG. 8 is a bottom isometric assembly view of the router, adjustable router base, and a radial extension member, particularly illustrating the manner in which the radial extension member can be releasably coupled to the lower member of the adjustable router base.

Referring now to FIG. 8, adjustable router base 10 can also comprise at least one elongated radial extension member 60. Extension member 60 defines a plurality of pivot openings 68 spaced from one another in the direction of elongation of radial extension member 60. Radial extension member 60 can be releasably coupled to lower member 14 in the manner that permits radial extension member 60 to extend a substantial distance outwardly from lower member 14. In a preferred embodiment of the present invention, base plate 24 of lower member 14 defines a slot 62 for receiving a proximal end of radial extension member 60. Extension member 60 can be coupled to lower member 14 by placing the proximal end of extension member 60 into slot 62 and securing the proximal end of extension member 60 in slot 62 with a plurality of removable screws. When radial extension member 60 is coupled to lower member 14, it is preferred for the substantially planar lower surface 64 presented by lower member 14 to be substantially co-planar with the substantially planar lower surface 66 of extension member 60.

In one embodiment of the present invention, extension member 60 is the first of several extension members coupled to lower member 14. The distal end of first extension member 60 defines threaded openings 70. Threaded openings 70 are configured similar to the threaded openings located in slot 62 of lower member 14. Thus, threaded openings 70 permit a second radial extension member of substantially the same configuration as first extension member 60 to be coupled to first extension member 60 by attaching the proximal end of the second extension member to the distal end of first extension member 60 and coupling the two extension members to one another by extending screws through openings in the proximal end of the second extension member and into threaded openings 70 of first extension member 60. Alternatively, multiple radial extension members can be coupled to one another using an additional connector piece (not shown) to couple the distal end of a first extension member to the proximal end of a second extension member. Such connector piece, if employed, is provided with a first set of threaded openings that align with the openings in the distal end of the first extension member and a second set of threaded openings that align with the openings in the proximal end of lthe second extension member. Removable screws can be used to couple the distal end of the first extension member to the connector piece and the proximal end of the second extension member to the connector piece, thereby rigidly coupling the first and second extension members to one another. By using multiple extension members, a radial extension of any desired length can be provided. The radial extension member(s) are preferably configured to extend at least about 12 inches away from the lower member of the router base, more preferably at least about 24 inches away from the lower member of the router base, and most preferably at least 48 inches away from the lower member of the router base.

Figure 4:
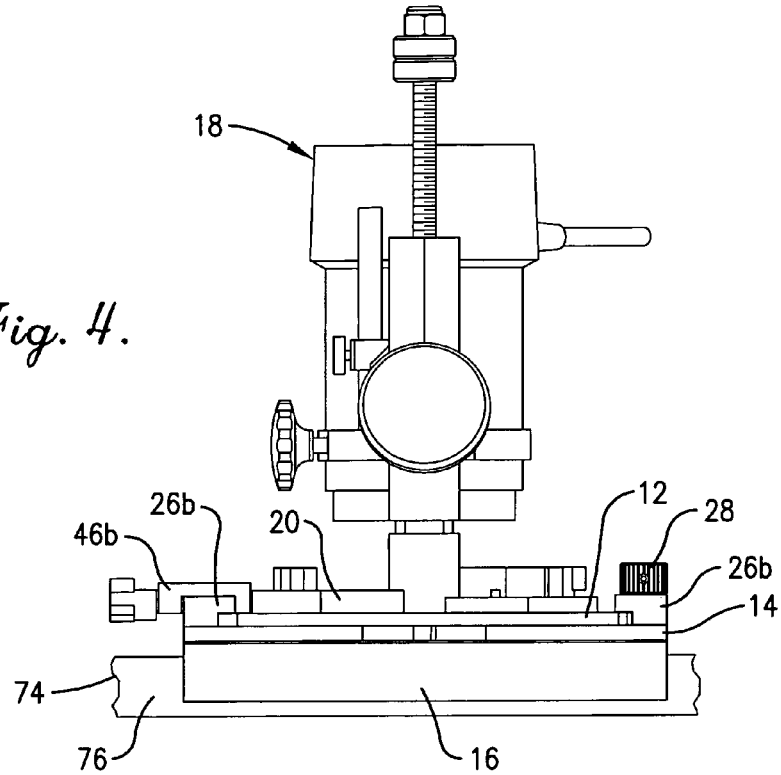
FIG. 4 is a front view of the router, adjustable router base, and workpiece indicated by lines 4-4 in FIG. 3, particularly illustrating the edge guide of the router base contacting a guiding edge of the workpiece.
Figure 6:
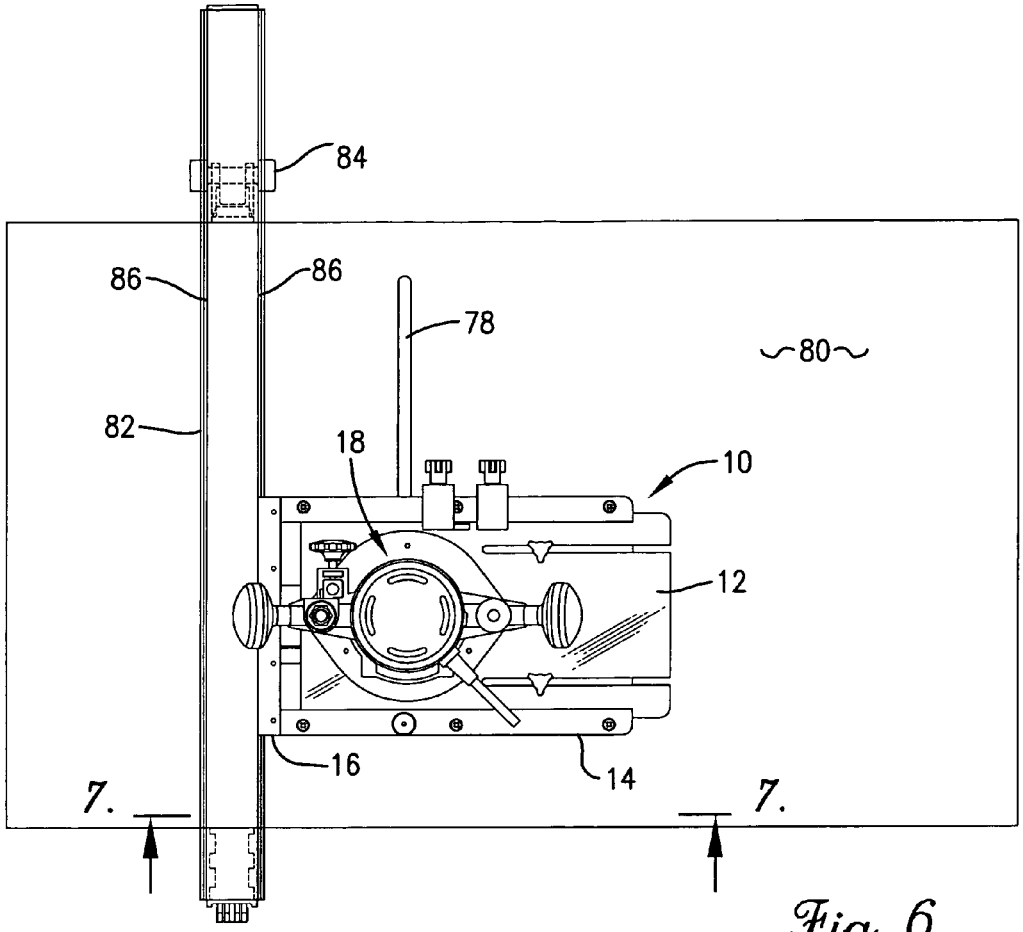
FIG. 6 is a top view of the router, adjustable router base, and a straight edge being used to cut a dado in a workpiece in a location that is remote from the edge of the workpiece, particularly illustrating the router base being guided by a slot in the straight edge.
Figure 9:
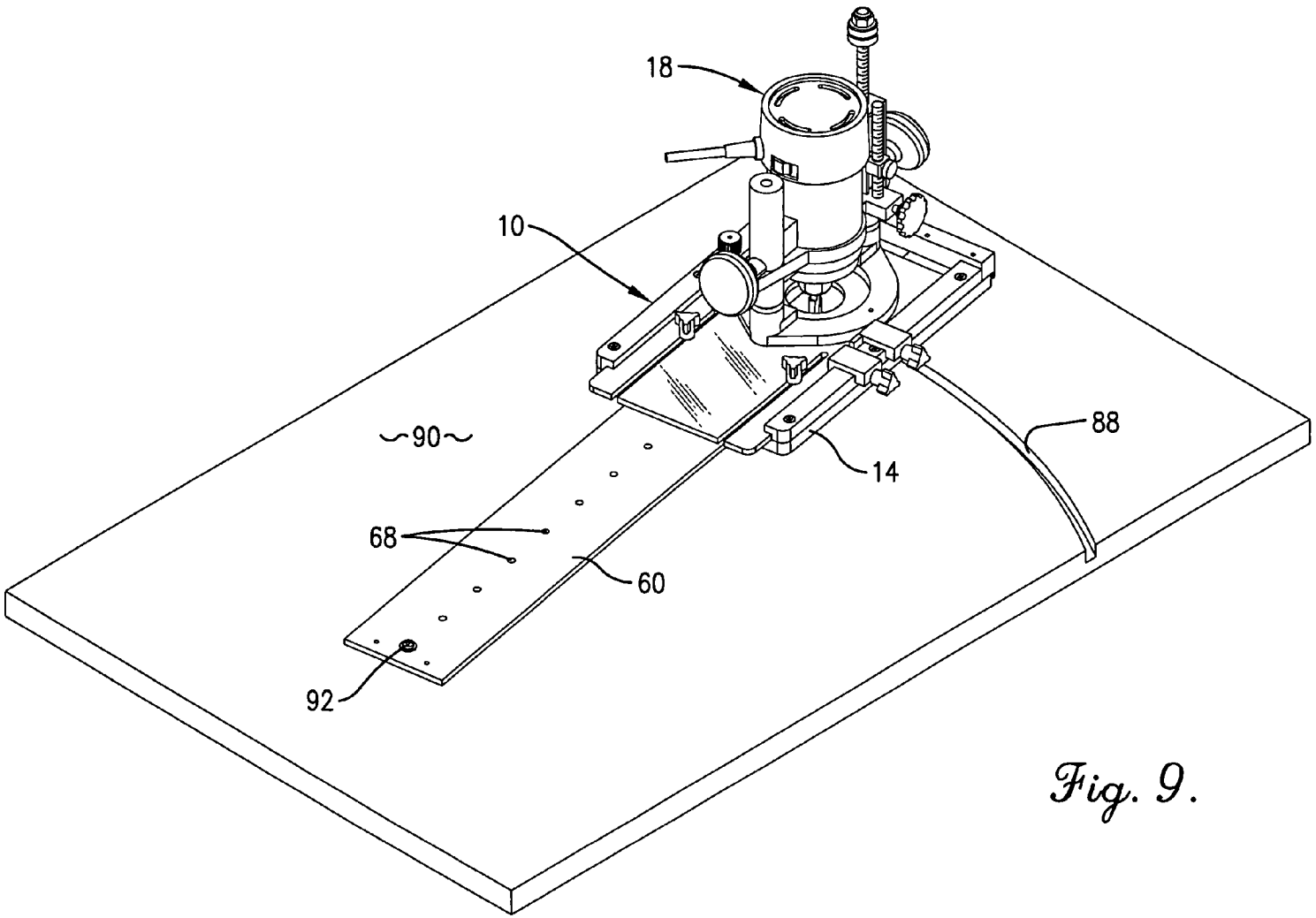
FIG. 9 is an isometric view of the router, adjustable router base, and radial extension member being used to cut an arcuate dado in a workpiece.

FIGS. 3-7 and 9 show router base 10 and router 18 in three distinct modes of operation. FIGS. 3-5 illustrate a "workpiece-guided mode of operation." FIGS. 6 and 7 illustrate a "straight edge-guided mode of operation." FIG. 9 illustrates a "pivot-guided mode of operation." As discussed previously, router base 10 and router 18 can also be used in a fourth "free-hand" mode of operation where upper member 12 of router base 10 is completely decoupled from lower member 14 and upper member 12 is simply employed as the base of router 18.

The workpiece-guided mode of operation illustrated in FIGS. 3-5 shows router base 10 and router 18 being employed to cut a dado 72 in a workpiece 74, while the position of router 18 and router base 10 relative to workpiece 74 is maintained by a guiding edge 76 of workpiece 74. When router base 10 and router 18 are employed in the workpiece-guided mode of operation, edge guide 16 is in the down position so that guide face 54 (FIG. 5) maintains contact with guiding edge 76 of workpiece 74 during cutting of dado 72. The workpiece-guided mode of operation is typically employed when it is desired to cut a dado near the edge of a workpiece. When it is desired to cut a dado in a location spaced a substantial distance from the edge of a workpiece, the straight edge-guided mode of operation illustrated in FIGS. 6 and 7 can be employed.

The straight edge-guided mode of operation illustrated in FIGS. 6 and 7 shows router base 10 and router 18 being employed to cut a dado 78 in a workpiece 80, while the position of router 18 and router base 10 relative to workpiece 80 is maintained by an elongated straight edge 82 which is rigidly coupled to workpiece 80 by at least one clamp 84. Straight edge 82 preferably defines at least one slot 86 presenting an upper open end. When router base 10 and router 18 are employed in the straight edge-guided mode of operation, edge guide 16 is in the up position with protrusion 52 extending downward into slot 86 (FIG. 7). When protrusion 52 is received in slot 86, protrusion 52 can travel through slot 86 in the direction of elongation of straight edge 82; however, shifting of protrusion 52 in slot 86 in a direction perpendicular to the direction of elongation of straight edge 52 is inhibited.

One way to ensure that edge guide 16 does not rotate in slot 86 is to configure protrusion 52 to extend a substantial distance along the length of slot 86. In the illustrated embodiment, protrusion 52 is a single elongated element that is received in slot 86. In an alternative embodiment, protrusion 52 can be formed by a plurality of separate protrusions. However, in either configuration, it is desirable for protrusion 52 to include a first end portion/member that is space from a second end portion/member by at least about 2 inches, measured in the direction of elongation of slot 86 when protrusion 52 is received in slot 86. More preferably, the first and second end portions/members of protrusion 52 are spaced from each other by at least about 4 inches, and most preferably at least 6 inches. Thus, protrusion 52 travels linearly through slot 86 without permitting rotation of edge guide 16 relative to straight edge 82 when router 18 is employed to cut dado 78 in workpiece 80.

As shown in FIG. 9, the pivot-guided mode of operation can be employed to cut an arcuate dado 88 in a workpiece 90. In the pivot-guided mode of operation, the proximal end of radial extension member 60 is coupled to lower member 14 of router base 10 and one of the pivot openings 68 is coupled to workpiece 90 by a pivot element 92. Pivot element 92 can simply be a screw or nail which extends through a pivot opening 68 of extension member 60 and is coupled to workpiece 90. The radius of curvature of arcuate dado 88 can be adjusted by selecting which pivot opening 68 through which to extend pivot element 92. If it is desired to cut arcuate dado 88 with a large radius of curvature, multiple intercoupled extension members 60 can be employed, as previously discussed.

In each of the three modes of operation described immediately above, a rigid "guide element" is used to guide the location and/or configuration of the cut. In the workpiece-guided mode of operation (FIGS. 3-5) the "guide element" is guiding edge 76 of workpiece 74. In the straight edge-guided mode of operation (FIGS. 6 and 7), the "guide element" is defined by slot 86 of straight edge 82, which is rigidly coupled to workpiece 80 during cutting of dado 78.

In the pivot-guided mode of operation (FIG. 9), the "guide element" is pivot element 92, which is rigidly coupled to workpiece 90 during cutting of arcuate dado 88.

In the three modes of operation described above with reference to FIGS. 3-9, adjustable router base 10 provides a number of common useful features. For example, router base 10 permits multiple cuts to be made at different distances from the guide element by shifting upper member 12 relative to lower member 14 with fine-tuning mechanism 28. These multiple cuts/passes can form separate grooves, or can be used to form a single groove having a width greater than the width of the router bit. When the guide element is a straight edge, the straight edge does not need to be reset (i.e., clamped to the workpiece at a different location) each time a new cut/pass is performed. Further, when the guide element is a pivot element used to create an arcuate dado, the pivot element does not need to be reset each time a new cut/pass is performed.

Another useful feature of adjustable router base 10 is the travel-limiting system formed by adjustable stops 46*a,b* and lug 48. This travel-limiting system allows the location and width of cuts/passes to be fixed so that an identical groove can be formed in multiple workpieces without having to re-measure for each workpiece. In addition, if it desired to change router bits during the middle of a cut (e.g., to transition to a different sized bit), the travel-limiting system can allow the router to be removed and returned to exactly the same position relative to the guide element without having to re-measure.

The preferred forms of the invention described above are to be used as illustration only, and should not be utilized in a limiting sense in interpreting the scope of the present invention. Obvious modifications to the exemplary embodiments and modes of operation, as set forth herein, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. An adjustable router base for guiding a router across a workpiece while said router is routing said workpiece, said router base comprising:

a normally-lower member presenting a substantially planar lower surface for flushly engaging said workpiece;

a normally-upper member coupled to said normally-lower member and shiftable relative to said normally-lower member, said normally-upper member being configured for rigid attachment to said router; and an edge guide coupled to said normally-lower member and shifiable between a down position and an up position, at least a portion of said edge guide extending below said substantially planar lower surface when in said down position so that movement of said router across said workpiece can be guided by engaging said edge guide against an edge of said workpiece during said routing, said edge guide being positioned entirely above said substantially planar lower surface when in said up position, wherein no portion of said router base extends below said substantially planar lower surface when said edge guide is in said up position so that said routing can be carried out while said router is attached to said router base and while said router base is spaced inwardly from the edges of said workpiece.

2. The adjustable router base of claim 1, said edge guide presenting a substantially planar guide face extending below said lower member when said edge guide is in said down position, said substantially planar guide face extending substantially perpendicular to said substantially planar lower surface when said edge guide is in said down position.

3. The adjustable router base of claim 1, said edge guide including a main body and a protrusion extending from said main body, said protrusion projecting generally downward when said guide member is in said up position, said protrusion projecting generally upward when said guide member is in said down position.

4. The adjustable router base of claim 1; and a fine-tuning system for selectively shifting said normally-upper member relative to said normally-lower member when said fine-tuning system is actuated.

5. The adjustable router base of claim 4, said fine-tuning a system comprising an actuating knob that rotates when said fine-tuning system is actuated.

6. The adjustable router base of claim 5, said fine-tuning system further comprising a first gear mechanism coupled to said normally-upper member and a second gear mechanism coupled to said normally-lower member, said actuating knob being coupled to said first gear mechanism so that rotation of said actuating knob causes rotation of said first gear mechanism.

7. The adjustable router base of claim 6, said first gear mechanism being a rack gear, said second gear mechanism being a pinion gear.

8. The adjustable router base of claim 1; and a scale for indicating the location of said normally-upper member relative to said normally-lower member.

9. The adjustable router base of claim 1; and a projecting lug fixed relative to said normally-upper member; and a first adjustable stop mechanism shiftably coupled to said normally-lower member, said lug and said first adjustable stop mechanism being configured to engage one another to thereby limit the travel of said normally-upper member relative to said normally-lower member in a first direction.

10. The adjustable router base of claim 9; and a second adjustable stop mechanism shiftably coupled to said normally-lower member, said lug and said second adjustable stop mechanism being configured to engage one another to thereby limit the travel of said normally-upper member relative to said normally-lower member in a second direction opposite said first direction, said first and second stop mechanisms being shiftable relative to said normally-lower member in said first and second directions.

11. The adjustable router base of claim 1, said normally-lower and normally-upper members being slidably intercoupled so as to permit relative translation of said normally-lower and normally-upper members only along a single substantially linear path.

12. The adjustable router base of claim 11, said normally-upper member defining an upper opening, said normally-lower member defining a lower opening, said lower opening being elongated along said substantially linear path relative to said upper opening so that at least a portion of said lower opening remains substantially aligned with at least a portion of said upper opening during shifting of said normally-upper member relative to said normally-lower member.

13. The adjustable router base of claim 1, said normally-upper member presenting a substantially planar bottom surface, said normally-lower member presenting a substantially planar upper surface, said bottom surface and said upper surface engaging one another.

14. The adjustable router base of claim 13, said normally-lower member including a pair of spaced-apart side guides receiving at least a portion of said normally-upper member therebetween, said side guides being configured to permit relative translation of said normally-upper and normally-lower members along a first line of travel while inhibiting relative translation of said normally-upper and normally-lower members along a second line of travel transverse to said first line of travel, said side guides being configured to maintain contact between said bottom surface of said normally-upper member and said upper surface of said normally-lower member.

15. The adjustable router base of claim 14; and a friction locking mechanism operable to selectively increase and decrease the frictional force between said bottom surface of said normally-upper member and said upper surface of said normally-lower member, thereby selectively locking and unlocking said normally-upper member and said normally-lower member relative to one another.

16. The adjustable router base of claim 1; and a radial extension member releasably coupled to said normally-lower member and extending at least about 12 inches outwardly from said normally-lower member.

17. The adjustable router base of claim 1, said normally-upper member being completely detachable from and reattachable to said normally-lower member, said normally-upper member presenting a substantially planar bottom surface.

18. An adjustable router base suitable for use in conjunction with a router and a straight edge, said router being capable of routing a workpiece, said straight edge being configured for releasable attachment to said workpiece, said straight edge having an elongated slot formed therein, said elongated slot presenting an open upper end, said adjustable router base comprising:

a normally-lower member presenting a substantially planar lower surface for flushly engaging said workpiece;

a normally-upper member configured for rigid attachment to said router, said normally-upper member being shiftably coupled to said normally-lower member; and a protrusion fixed relative to said normally-lower member and extending in a generally downward direction, said protrusion being configured for receipt in said elongated slot of said straight edge so that during said routing said protrusion can travel through said elongated slot in the direction of elongation of said slot while inhibiting shifting of said protrusion in said slot in a direction perpendicular to the direction of elongation of said slot, thereby permitting said straight edge to guide movement of said router relative to said workpiece during said routing, wherein no portion of said router base extends below said substantially planar lower surface so that said routing can be carried out while said router is attached to said router base and while said router base is spaced inwardly from the edges of said workpiece.

19. The adjustable router base of claim 18; and an edge guide coupled to said normally-lower member and comprising said protrusion.

20. The adjustable router base of claim 19, said edge guide including a main body secured to said normally-lower member, said protrusion projecting from said main body, said protrusion being spaced from said normally-lower member.

21. The adjustable router base of claim 19, said edge guide being shiftable relative to said normally-lower member between a down position and an up position, said protrusion projecting generally upward when said guide member is in said down position, said protrusion projecting generally downward when said guide member is in said up position.

22. The adjustable router base of claim 18, said protrusion including two end portions spaced from one another by at least about 2 inches.

23. The adjustable router base of claim 18, said normally-lower and normally-upper members being slidably intercoupled in a manner that permits relative translation of said normally-lower and normally-upper members only along a single substantially linear path.

24. The adjustable router base of claim 23; and a fine-tuning system for selectively shifting said normally-upper member relative to said normally-lower member along said substantially linear path when said fine-tuning system is actuated, said fine-tuning system comprising an actuating knob that rotates when said fine-tuning system is actuated.

25. The adjustable router base of claim 24, said fine-tuning system further comprising a first gear mechanism coupled to said normally-upper member and a second gear mechanism coupled to said normally-lower member, said first gear mechanism being a rack gear, said second gear mechanism being a pinion gear.

26. The adjustable router base of claim 24; and a scale for indicating the location of said normally-upper member relative to said normally-lower member.

27. The adjustable router base of claim 23, said normally-lower member including a pair of spaced-apart side guides receiving at least a portion of said normally-upper member therebetween, said side guides coupling said normally-upper member and said normally-lower member to one another.

28. The adjustable router base of claim 27, said side guides being configured to permit relative translation of said normally-upper and normally-lower members along said single substantially linear path while inhibiting relative translation of said normally-upper and normally-lower members in any other direction.

29. The adjustable router base of claim 18; and a friction locking mechanism for selectively fixing the positions of said normally-upper member and said normally-lower member relative to one another.

* * * * *